US012151155B2

(12) United States Patent
Kleinert

(10) Patent No.: US 12,151,155 B2
(45) Date of Patent: Nov. 26, 2024

(54) GLOVE WITH EXPANDABLE FINGER STALL

(71) Applicant: Hillerich & Bradsby Co., Louisville, KY (US)

(72) Inventor: James M. Kleinert, Turners Station, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 82 days.

(21) Appl. No.: 17/485,894

(22) Filed: Sep. 27, 2021

(65) Prior Publication Data

US 2022/0080288 A1 Mar. 17, 2022

Related U.S. Application Data

(63) Continuation of application No. 15/162,103, filed on May 23, 2016, now Pat. No. 11,130,043.

(60) Provisional application No. 62/164,634, filed on May 21, 2015.

(51) Int. Cl.

| | |
|---|---|
| ***A63B 71/14*** | (2006.01) |
| ***A41D 19/00*** | (2006.01) |
| ***A41D 19/015*** | (2006.01) |
| ***A63B 102/18*** | (2015.01) |

(52) U.S. Cl.

CPC ..... *A63B 71/146* (2013.01); *A41D 19/0048* (2013.01); *A41D 19/01576* (2013.01); *A63B 71/143* (2013.01); *A63B 2102/18* (2015.10); *A63B 2102/182* (2015.10); *A63B 2209/10* (2013.01)

(58) Field of Classification Search

CPC .. A63B 71/143; A63B 71/146; A41D 19/0048
USPC ..... 2/163
See application file for complete search history.

(56) References Cited

U.S. PATENT DOCUMENTS

| | | | |
|---|---|---|---|
| 325,968 | A | 9/1885 | Rawlings |
| 385,728 | A | 7/1888 | Sauer |
| 482,647 | A | 9/1892 | Obear |
| RE12,996 | E | 7/1909 | Peach |
| 1,018,271 | A | 2/1912 | Rogers |

(Continued)

FOREIGN PATENT DOCUMENTS

| | | |
|---|---|---|
| CA | 2683608 | 4/2010 |
| GB | 710394 | 6/1954 |

(Continued)

OTHER PUBLICATIONS

United States Patent and Trademark Office (ISA/US; International Search Report of the Internation Searching Authority; Apr. 23, 2003; pp. 1-3; PCT/US02/19390; U.S. Patent and Trademark Office; USA.

(Continued)

*Primary Examiner* — Alissa J Tompkins
*Assistant Examiner* — Catherine M Ferreira
(74) *Attorney, Agent, or Firm* — Gray Ice Higdon

(57) ABSTRACT

The invention is a glove having a palmar side panel and a dorsal side panel and a thumb stall and a plurality of finger stalls for receiving a thumb and fingers of a human hand. The invention further includes a finger or thumb stall having a transverse expansion zone and/or a longitudinal expansion zone comprised of expandable material for accommodating fingers of varying sizes.

20 Claims, 5 Drawing Sheets

(56) References Cited

U.S. PATENT DOCUMENTS 1,202,705 A 10/1916 Goldsmith et al.
1,435,478 A 11/1922 Kennedy
1,436,131 A 11/1922 Whitley
1,496,824 A 6/1924 Nixon, Jr.
1,525,298 A 2/1925 Hartman
1,552,080 A 9/1925 Rainey
1,562,176 A 11/1925 Latina
RE16,272 E 2/1926 Green
1,594,304 A 7/1926 Klahn et al.
D72,069 S 2/1927 Meyers
1,716,221 A 6/1929 Fernie
1,841,193 A 1/1932 Lidston
1,900,395 A 3/1933 Gitt
2,036,413 A 4/1937 Herbruck
2,083,935 A 6/1937 Arnold
2,258,999 A 10/1941 Nunn
2,344,080 A 3/1944 Burgett
2,369,115 A 2/1945 Bloom
2,465,136 A 3/1949 Troccoli
2,528,802 A 11/1950 Turner
2,558,544 A 6/1951 Delsalle
2,567,489 A 9/1951 Lewis
2,636,172 A 4/1953 Stobbe
2,750,594 A 6/1956 Denkert
2,975,429 A 3/1961 Newman
2,980,915 A 4/1961 Peterson
3,042,929 A 7/1962 Kobos
3,096,523 A 7/1963 Bruchas
3,164,841 A 1/1965 Burtoff
3,175,226 A 3/1965 Weinberg
3,273,165 A 9/1966 Sperandeo
3,290,695 A 12/1966 Burtoff
3,300,787 A 1/1967 Denkert
3,411,222 A 11/1968 Williams
D213,287 S 2/1969 Khazzam
3,458,867 A 8/1969 Moore et al.
3,532,344 A 10/1970 Masstab
3,564,613 A 2/1971 Fowler
3,576,036 A 4/1971 Latina
3,588,915 A 6/1971 Latina
3,605,117 A 9/1971 Latina
3,606,614 A 9/1971 Dimitroff
3,649,966 A 3/1972 Shields
3,707,730 A 1/1973 Slider
3,918,096 A 11/1975 Lim
D240,671 S 7/1976 McTear
D240,672 S 7/1976 McTear
3,997,922 A 12/1976 Huhta
3,997,992 A 12/1976 Anderson
4,027,339 A 6/1977 Brucker
4,038,787 A 8/1977 Bianchi
4,042,975 A 8/1977 Elliott, Jr. et al.
4,051,552 A 10/1977 Widdemer
4,051,553 A 10/1977 Howard
4,067,063 A 1/1978 Ettinger
4,068,312 A 1/1978 Ledesma
4,084,584 A 4/1978 Detty
4,095,292 A 6/1978 Klein
D248,898 S 8/1978 DeLeone et al.
4,137,572 A 2/1979 Jansson et al.
4,176,839 A 12/1979 Pinkus
4,187,557 A 2/1980 Tombari
4,201,203 A 5/1980 Applegate
4,250,578 A 2/1981 Barlow
4,262,800 A 4/1981 Nethercutt
4,272,849 A 6/1981 Thurston et al.
4,272,850 A 6/1981 Rule
4,287,885 A 9/1981 Applegate
4,300,567 A 11/1981 Kolenik et al.
4,329,741 A 5/1982 Bach
4,346,481 A 8/1982 Latina
4,438,532 A 3/1984 Campanella et al.
4,445,507 A 5/1984 Eisenberg
4,446,970 A 5/1984 Further
4,524,464 A 6/1985 Primiano et al.
4,546,495 A 10/1985 Castillo
4,561,122 A 12/1985 Stanley et al.
4,570,269 A 2/1986 Berlese
4,589,146 A 5/1986 Taylor
4,590,625 A 5/1986 Keim
4,630,318 A 12/1986 Aoki
4,663,783 A 5/1987 Obayashi
4,665,561 A 5/1987 Aoki
4,677,698 A 7/1987 Angas
4,684,123 A 8/1987 Fabry
4,691,387 A 9/1987 Lopez
4,700,404 A 10/1987 Potvin
D294,984 S 3/1988 Green
4,747,163 A 5/1988 Dzierson
4,748,690 A 6/1988 Webster
4,751,749 A 6/1988 Cowhey
4,766,612 A 8/1988 Patton, Sr.
4,815,147 A 3/1989 Gazzano et al.
4,843,651 A 7/1989 Gramza et al.
4,847,915 A 7/1989 Keene
4,850,053 A 7/1989 Tepley et al.
4,864,659 A 9/1989 Morris
4,864,660 A 9/1989 Sawyer
4,886,071 A 12/1989 Mehl et al.
4,891,845 A 1/1990 Hayes
4,896,376 A 1/1990 Miner
4,911,433 A 3/1990 Walker et al.
4,930,162 A 6/1990 Cote
4,954,239 A 9/1990 Mueller
4,958,384 A 9/1990 McCrane
4,967,418 A 11/1990 Marcotte
5,004,227 A 4/1991 Hoffman
5,016,286 A 5/1991 Henriksen
5,028,050 A 7/1991 Freyer
5,031,238 A 7/1991 Hayes
D320,871 S 10/1991 Bothof, III et al.
D320,872 S 10/1991 McCrane
5,058,209 A 10/1991 Eisenberg
5,058,573 A 10/1991 Hess et al.
5,067,175 A 11/1991 Gold
5,083,361 A 1/1992 Rudy
5,107,544 A 4/1992 Capatosto
5,117,981 A 6/1992 Crawford et al.
D328,369 S 7/1992 Hong
5,136,725 A 8/1992 Montero
5,146,624 A 9/1992 Bruckner
5,168,576 A 12/1992 Krent et al.
5,168,578 A 12/1992 Stanley
D332,845 S 1/1993 Johnston
5,175,886 A 1/1993 Suk
5,195,188 A 3/1993 Bourdeau et al.
5,214,799 A 6/1993 Fabry
5,218,718 A 6/1993 Chih
5,218,719 A 6/1993 Johnson
D338,280 S 8/1993 Krent et al.
5,237,703 A 8/1993 Brine et al.
5,253,365 A 10/1993 Clevenhagen
5,257,418 A 11/1993 Jaskiewicz
5,309,573 A 5/1994 Solar et al.
5,323,490 A 6/1994 Yarbrough
5,328,652 A 7/1994 Thomson
5,329,639 A 7/1994 Aoki
5,330,391 A 7/1994 Mitchell
D351,050 S 9/1994 Sheldon
5,345,609 A 9/1994 Fabry et al.
5,379,460 A 1/1995 Aoki
D356,203 S 3/1995 Mitch
D360,284 S 7/1995 Paffett et al.
5,435,008 A 7/1995 Shane
5,442,815 A 8/1995 Cordova et al.
5,442,816 A 8/1995 Seketa
D362,927 S 10/1995 McCrane
5,459,878 A 10/1995 Gold
5,462,280 A 10/1995 Dickerson
5,471,682 A 12/1995 Robins et al.
5,477,558 A 12/1995 Volker et al.
5,488,739 A 2/1996 Cardinal
5,490,290 A 2/1996 Gold
D367,731 S 3/1996 Estwanik

(56) References Cited

U.S. PATENT DOCUMENTS 5,500,955 A 3/1996 Gongea
5,511,242 A 4/1996 Bianchi
5,511,243 A 4/1996 Hall et al.
5,511,244 A 4/1996 Shikatani
5,520,041 A 5/1996 Haswell
5,530,967 A 7/1996 Cielo
5,551,083 A 9/1996 Goldsmith
5,557,803 A 9/1996 Granich et al.
5,557,806 A 9/1996 Caswell et al.
5,564,122 A 10/1996 Wagner
5,569,225 A 10/1996 Fleury
5,575,005 A 11/1996 Walker et al.
5,581,809 A 12/1996 Mah
5,592,688 A 1/1997 LaRonge et al.
D378,148 S 2/1997 Haney
5,598,582 A 2/1997 Andrews et al.
5,600,853 A 2/1997 Yewer, Jr.
5,608,912 A 3/1997 Cumberland
5,608,915 A 3/1997 Libit
5,634,214 A 6/1997 St. Ville
5,638,548 A 6/1997 Kawakami
5,640,712 A 6/1997 Hansen et al.
5,644,795 A 7/1997 Landis et al.
5,655,221 A 8/1997 Worischeck
5,655,226 A 8/1997 Williams
5,659,897 A 8/1997 Satoh
5,672,151 A 9/1997 Calderon-Garciduenas
D385,667 S 10/1997 Goldsmith
5,675,839 A 10/1997 Gordon et al.
5,678,245 A 10/1997 Rector et al.
5,682,613 A 11/1997 Dinatale
5,685,014 A 11/1997 Dapsalmon
5,692,242 A 12/1997 Tekerman et al.
5,694,642 A 12/1997 Rector et al.
5,697,103 A 12/1997 Wiggins
5,697,104 A 12/1997 Welton
D389,283 S 1/1998 Goldsmith et al.
5,706,521 A 1/1998 Haney
5,708,979 A * 1/1998 Redwood ..... A41D 19/01582 2/167
5,715,539 A 2/1998 Benecki et al.
5,717,994 A 2/1998 Goldsmith
5,717,995 A 2/1998 Murai
5,720,047 A 2/1998 Spitzer
5,725,566 A 3/1998 Pioger et al.
5,728,071 A 3/1998 Watson et al.
5,738,641 A 4/1998 Watson et al.
5,745,916 A 5/1998 Linner
5,761,745 A 6/1998 Sato
5,778,449 A 7/1998 Oetting et al.
5,781,929 A 7/1998 Shikatani
5,781,931 A 7/1998 Lee
5,785,617 A 7/1998 MacKay, Jr.
5,787,506 A 8/1998 Wilder et al.
5,790,980 A 8/1998 Yewer, Jr.
5,792,102 A 8/1998 Muller-Spath
5,799,327 A 9/1998 Clevenhagen
5,802,614 A 9/1998 Melone, Jr.
5,806,092 A 9/1998 Shikatani
5,809,571 A 9/1998 Spitzer
5,815,839 A 10/1998 Safford
5,815,840 A 10/1998 Hamlin
5,819,312 A 10/1998 Snyder et al.
5,855,022 A 1/1999 Storto
5,878,436 A 3/1999 Jones
5,884,329 A 3/1999 Goldsmith et al.
5,887,282 A 3/1999 Lenhart
5,893,172 A 4/1999 Haynes et al.
5,898,938 A 5/1999 Baylor et al.
5,898,942 A 5/1999 Anderson
5,926,847 A 7/1999 Eibert
5,946,720 A 9/1999 Sauriol
5,963,985 A 10/1999 Behr et al.
5,983,396 A 11/1999 Morrow et al.
5,987,642 A 11/1999 Webster
5,987,646 A 11/1999 Bolmer
D417,757 S 12/1999 Aoki
5,996,117 A 12/1999 Goldsmith et al.
6,000,059 A 12/1999 Abts
6,006,751 A 12/1999 Spitzer
6,012,170 A 1/2000 Kim
6,016,571 A 1/2000 Guzman et al.
D420,173 S 2/2000 Aoki
D420,174 S 2/2000 Aoki
D420,202 S 2/2000 Redwood et al.
6,035,443 A 3/2000 Green
6,041,438 A 3/2000 Kirkwood
6,049,910 A 4/2000 McCarter
6,052,827 A 4/2000 Widdemer
6,065,150 A 5/2000 Huang
6,065,659 A 5/2000 Faz
D426,922 S 6/2000 Redwood et al.
6,085,352 A 7/2000 Martin
6,088,835 A 7/2000 Perkins et al.
6,098,200 A 8/2000 Minkow et al.
6,105,162 A 8/2000 Douglas et al.
6,119,267 A 9/2000 Pozzi
6,122,769 A 9/2000 Wilder et al.
D431,691 S 10/2000 Redwood et al.
6,159,243 A 12/2000 Schouwenburg
6,182,289 B1 2/2001 Brown
6,185,747 B1 2/2001 Hughes
6,206,871 B1 3/2001 Zanon et al.
6,216,276 B1 4/2001 Eibert
6,223,350 B1 5/2001 McFarlane
6,223,744 B1 5/2001 Garon
6,226,795 B1 5/2001 Winningham
6,233,744 B1 5/2001 McDuff
6,249,915 B1 6/2001 Hang
6,253,382 B1 7/2001 Kleinert
6,256,792 B1 7/2001 MacDonald
6,264,619 B1 7/2001 Ferguson
D445,996 S 8/2001 Kiernan
6,275,996 B1 8/2001 Redwood et al.
6,279,160 B1 8/2001 Chen
6,279,163 B1 8/2001 Hale et al.
6,289,515 B1 9/2001 Fous
6,289,516 B1 9/2001 Motooka et al.
6,321,387 B1 11/2001 Fukae
6,341,376 B1 1/2002 Smerdon, Jr.
6,353,931 B1 3/2002 Gilligan et al.
6,378,925 B1 4/2002 Greenlee
6,389,601 B2 5/2002 Kleinert
6,405,380 B1 6/2002 Kuroda et al.
6,415,444 B1 7/2002 Kleinert
6,415,445 B1 7/2002 Nishijima et al.
D461,621 S 8/2002 Bevier
6,427,247 B1 8/2002 Suk
6,430,745 B2 8/2002 Murai
D462,922 S 9/2002 Yuan et al.
6,453,474 B2 9/2002 Kleinert
D464,178 S * 10/2002 Redwood ..... D29/123
6,460,184 B1 10/2002 Nishimura et al.
6,487,724 B1 12/2002 Aoki
D468,075 S 1/2003 Votel
6,502,244 B1 1/2003 Kleinert
6,502,699 B1 1/2003 Watson
6,516,470 B1 2/2003 Aoki
6,516,471 B1 2/2003 Baumann
6,519,781 B1 2/2003 Berns
D471,343 S 3/2003 Sun
D471,674 S 3/2003 Redwood et al.
6,526,592 B1 3/2003 Best
6,536,046 B1 3/2003 Gilligan
6,543,058 B2 4/2003 Litke
6,553,576 B1 4/2003 Knapp
D474,863 S 5/2003 Sun
D474,963 S 5/2003 Gersten et al.
6,571,394 B1 6/2003 Hackett et al.
6,584,616 B2 7/2003 Godshaw et al.
6,618,860 B1 9/2003 Sullivan et al.
6,651,255 B1 11/2003 Schild
6,662,942 B1 12/2003 Bonzagni
6,668,379 B2 12/2003 Kleinert

(56) References Cited

U.S. PATENT DOCUMENTS

| | | | | |
|---|---|---|---|---|
| 6,681,402 | B1 | 1/2004 | Bevier et al. | |
| 6,701,530 | B2 | 3/2004 | Kleinert | |
| 6,704,939 | B2 | 3/2004 | Faulconer | |
| 6,708,346 | B2 | 3/2004 | Terris et al. | |
| 6,715,152 | B2 | 4/2004 | Mazzarolo | |
| 6,721,960 | B1 | 4/2004 | Levesque et al. | |
| 6,732,377 | B1 | 5/2004 | Wilkinson | |
| 6,745,402 | B2 | 6/2004 | Caswell | |
| 6,760,923 | B1 | 7/2004 | Tate | |
| 6,760,924 | B2 | 7/2004 | Hatch et al. | |
| D495,097 | S | 8/2004 | Redwood et al. | |
| 6,775,847 | B2 | 8/2004 | Terris et al. | |
| D499,529 | S | 12/2004 | Kleinert | |
| D499,856 | S | 12/2004 | Kleinert | |
| 6,832,391 | B1 | 12/2004 | Bower | |
| 6,845,514 | B1 | 1/2005 | Yao | |
| 6,845,519 | B2 | 1/2005 | Garneau | |
| 6,851,123 | B1 | 2/2005 | Kleinert | |
| 6,862,744 | B2 | 3/2005 | Kuroda et al. | |
| 6,868,553 | B2 | 3/2005 | Kleinert | |
| 6,889,389 | B2 | 5/2005 | Kleinert | |
| 6,961,960 | B2 | 11/2005 | Gold et al. | |
| D513,828 | S | 1/2006 | Bevier | |
| D514,772 | S | 2/2006 | Bevier | |
| 7,000,253 | B1 | 2/2006 | Kleinert | |
| 7,000,256 | B2 | 2/2006 | Kleinert | |
| 7,000,257 | B2 | 2/2006 | Bevier | |
| 7,003,806 | B1 | 2/2006 | Kleinert et al. | |
| D516,277 | S | 3/2006 | Mattesky | |
| D527,149 | S | 8/2006 | Bonzagni et al. | |
| D529,236 | S | 9/2006 | Litke et al. | |
| 7,100,212 | B2 | 9/2006 | Jaeger | |
| D529,665 | S | 10/2006 | Litke et al. | |
| D532,162 | S | 11/2006 | Bonzagni et al. | |
| 7,171,696 | B2 | 2/2007 | Falone et al. | |
| D545,002 | S | 6/2007 | Voravan | |
| D549,398 | S | 8/2007 | Swartz et al. | |
| D549,886 | S | 8/2007 | Kleinert | |
| D551,395 | S | 9/2007 | Clark | |
| 7,275,268 | B2 | 10/2007 | Gait | |
| D554,808 | S | 11/2007 | Litke et al. | |
| 7,353,544 | B1 | 4/2008 | Kleinert | |
| D569,556 | S | 5/2008 | Cooper et al. | |
| D570,056 | S | 5/2008 | Metcalf | |
| 7,406,719 | B2 | 8/2008 | Aoki | |
| D581,102 | S | 11/2008 | Faulconer | |
| D583,527 | S | 12/2008 | Kleinert | |
| D583,528 | S | 12/2008 | Kleinert | |
| 7,464,446 | B2 | 12/2008 | Johansson | |
| D584,026 | S | 1/2009 | Kleinert | |
| D584,027 | S | 1/2009 | Kleinert | |
| D595,456 | S | 6/2009 | Kleinert | |
| D595,457 | S | 6/2009 | Kleinert | |
| D595,458 | S | 6/2009 | Kleinert | |
| D595,904 | S | 7/2009 | Kleinert | |
| D597,728 | S | 8/2009 | Kleinert | |
| D597,729 | S | 8/2009 | Kleinert | |
| D597,730 | S | 8/2009 | Kleinert | |
| D598,636 | S | 8/2009 | Kleinert | |
| 7,578,006 | B2 | 8/2009 | Garneau | |
| D599,960 | S | 9/2009 | Ash et al. | |
| D604,027 | S | 11/2009 | Kleinert | |
| D612,576 | S | 3/2010 | Toth | |
| 7,707,653 | B2 | 5/2010 | Kleinert | |
| 7,895,669 | B2 | 3/2011 | Kleinert | |
| 7,895,670 | B2 | 3/2011 | Kleinert | |
| D637,765 | S | 5/2011 | Singh | |
| 7,937,773 | B1 | 5/2011 | Kleinert | |
| D640,856 | S | 7/2011 | Rose | |
| RE42,729 | E | 9/2011 | Kleinert | |
| D651,408 | S | 1/2012 | Farkas | |
| 8,096,901 | B2 | 1/2012 | Russotti | |
| 8,104,098 | B1 | 1/2012 | Kleinert | |
| 8,276,215 | B2 | 10/2012 | Merkle et al. | |
| D680,276 | S | 4/2013 | Kleinert | |
| D699,640 | S | 2/2014 | Duderstadt | |
| 11,130,043 | B2 | 9/2021 | Kleinert | |
| 2001/0025382 | A1 | 10/2001 | Murai | |
| 2001/0054190 | A1 | 12/2001 | Kleinert | |
| 2002/0013961 | A1 | 2/2002 | Kleinert | |
| 2002/0040494 | A1 | 4/2002 | Kleinert | |
| 2002/0042940 | A1 | 4/2002 | Kuroda et al. | |
| 2002/0152536 | A1 | 10/2002 | Kuroda et al. | |
| 2003/0005506 | A1* | 1/2003 | Litke | A63B 71/146 2/161.2 |
| 2003/0050586 | A1 | 3/2003 | Domanski et al. | |
| 2003/0051285 | A1 | 3/2003 | Bower | |
| 2003/0056273 | A1 | 3/2003 | Kleinert | |
| 2003/0061651 | A1 | 4/2003 | DeRose, Sr. | |
| 2003/0205232 | A1 | 11/2003 | Spitzer | |
| 2004/0016038 | A1 | 1/2004 | Motooka et al. | |
| 2004/0025226 | A1 | 2/2004 | Jaeger | |
| 2004/0025227 | A1 | 2/2004 | Jaeger | |
| 2004/0103465 | A1 | 6/2004 | Kleinert | |
| 2004/0107476 | A1 | 6/2004 | Goldwitz | |
| 2004/0111786 | A1 | 6/2004 | Terris et al. | |
| 2004/0123371 | A1 | 7/2004 | Bryant, Sr. | |
| 2004/0216207 | A1 | 11/2004 | Anderson | |
| 2004/0221365 | A1 | 11/2004 | Fitzgerald | |
| 2005/0034213 | A1 | 2/2005 | Bamber | |
| 2005/0114982 | A1 | 6/2005 | Gremmert | |
| 2006/0026738 | A1 | 2/2006 | Kleinert | |
| 2006/0137067 | A1 | 6/2006 | Wu | |
| 2006/0195968 | A1 | 9/2006 | Powell et al. | |
| 2007/0061943 | A1* | 3/2007 | Kleinert | A41D 19/01576 2/159 |
| 2007/0083968 | A1* | 4/2007 | Stokes | A41D 19/01505 2/16 |
| 2007/0150998 | A1 | 7/2007 | Atherton | |
| 2007/0150999 | A1 | 7/2007 | Brown | |
| 2007/0209097 | A1 | 9/2007 | Iacullo | |
| 2007/0226873 | A1 | 10/2007 | Mattesky | |
| 2008/0052799 | A1 | 3/2008 | Yoo | |
| 2008/0060115 | A1 | 3/2008 | Morris | |
| 2008/0072358 | A1 | 3/2008 | Kleinert | |
| 2008/0141435 | A1 | 6/2008 | Friedman | |
| 2008/0263745 | A1 | 10/2008 | Grilliot et al. | |
| 2009/0139010 | A1 | 6/2009 | Bevier | |
| 2009/0320178 | A1 | 12/2009 | Faulconer | |
| 2012/0017351 | A1 | 1/2012 | McCrane | |
| 2012/0131715 | A1 | 5/2012 | Copeland et al. | |
| 2012/0131716 | A1 | 5/2012 | Copeland et al. | |
| 2012/0227157 | A1 | 9/2012 | Kleinert | |
| 2012/0227158 | A1 | 9/2012 | Ashworth | |
| 2014/0304886 | A1 | 10/2014 | Eugene | |
| 2017/0181487 | A1* | 6/2017 | Kleinert | A63B 71/146 |

FOREIGN PATENT DOCUMENTS

| | | |
|---|---|---|
| JP | 401171849 | 7/1989 |
| JP | 09182825 | 7/1997 |
| JP | 2003020504 | 1/2003 |
| WO | WO9716085 | 5/1997 |
| WO | WO9827837 | 7/1998 |
| WO | 2288593 | 5/2000 |
| WO | WO03082036 | 10/2003 |

OTHER PUBLICATIONS

United States Patent and Trademark Office (ISA/US); International Search Report of the International Searching Authority; Apr. 7, 2005;pp. 1-3; PCT/US03/41488; U.S. Patent and Trademark Office; USA.

European Patent Office; International Search Report and Written Opinion of the International Searching Authority, or the Declaration; International Search Report and Written Opinion for PCT/US2012/027821; Jun. 29, 2012; pp. 1-8; European Patent Office, the Netherlands.

Anonymous: "Sportco Source" Internet Article, [Online] Apr. 27, 2006 (Apr. 27, 2006), XP002473014, Retrieved from the Internet: URL: http://web.archive. org/web/20060427131931/http://www.

(56) References Cited

OTHER PUBLICATIONS sportco-int.com/baseballgloves.htm> [retrieved on Mar. 17, 2008], p. 9.
Anonymous: "The Coolmax Golf Glove", Internet Article, [Online] Aug. 29, 2006 (Aug. 29, 2006), XP002473015, Retrieved from the Internet: URL: http://web.archive.org/web/20060829123241/http://www.hsc.csu.edu.au/textilesdesign/performan ce/2795/glove.htm> [retrieved on Mar. 17, 2008] the whole document.
European Paatent Office (ISA/EP); International Search Report and Written Opinion of the International Searching Authority, or the Declaration; Apr. 10, 2008; pp. 1-20; PCT/US2007/023054; European Patent Office; the Netherlands.
United States Patent and Trademark Office (ISA/US); International Search Report and Written Opinion of the International Searching Authority, or the Declaration; May 9, 2005; pp. 1-8; PCT/US04/31316; U.S. Patent and Trademark Office; USA.
European Patent Office (ISA/EP); International Search Report and Written Opinion of the International Searching Authority, or the Declaration; Apr. 13, 2007; pp. 1-8; PCT/US2006/038290; European Patent Office; the Netherlands.
European Patent Office (ISA/EP); International Search Report and Written Opinion of the International Searching Authority, or the Declaration; Jan. 23, 2008; pp. 1-12; PCT/US2007/017302; European Patent Office; the Netherlands.
United States Patent and Trademark Office (ISA/US); International Search Report of the International Searching Authority; Jul. 17, 2003; pp. 1-5; PCT/US03/09409; U.S. Patent and Trademark Office; USA.
European Patent Office (ISA/EP); International Search Report; Jun. 22, 2001; pp. 1-3; PCT/US2001/02608; European Patent Office; the Netherlands.
Knecht, Petra: "Funktionstextilien" 2003, Deutscher Fachverlag GmbH, Frankfurt Am Main, XP002473095, pp. 62,63 and pp. 282, 283.

* cited by examiner

GLOVE WITH EXPANDABLE FINGER STALL

BACKGROUND OF THE INVENTION

Field of the Invention

This invention relates to gloves for the human hand which are worn when playing sports such as baseball, softball, golf, or simply working. In one aspect, this invention relates to a glove specifically designed to improve grip, comfort, protection, and performance of a wearer. However, this invention has broader implications and may be advantageously employed in other applications requiring protection of the hands. More particularly, this invention relates to a glove which includes a thumb or finger stall that is both circumferentially and longitudinally expandable during use by the wearer.

One disadvantage with existing gloves is that the finger and thumb stalls are made to fit the hands of an "average" user rather than a hand of predetermined size. However, human fingers vary greatly in size, both circumference and length. From an anatomical perspective the thumb in particular varies more in size than any other digit. Accordingly, many gloves have thumb or finger stalls that fit the average person poorly. It is one object of the instant invention to provide a glove having a thumb stall that obviates this disadvantage by providing an adjustable or self-adjusting thumb stall to fit many different thumb sizes.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE INVENTION

Figure 1:
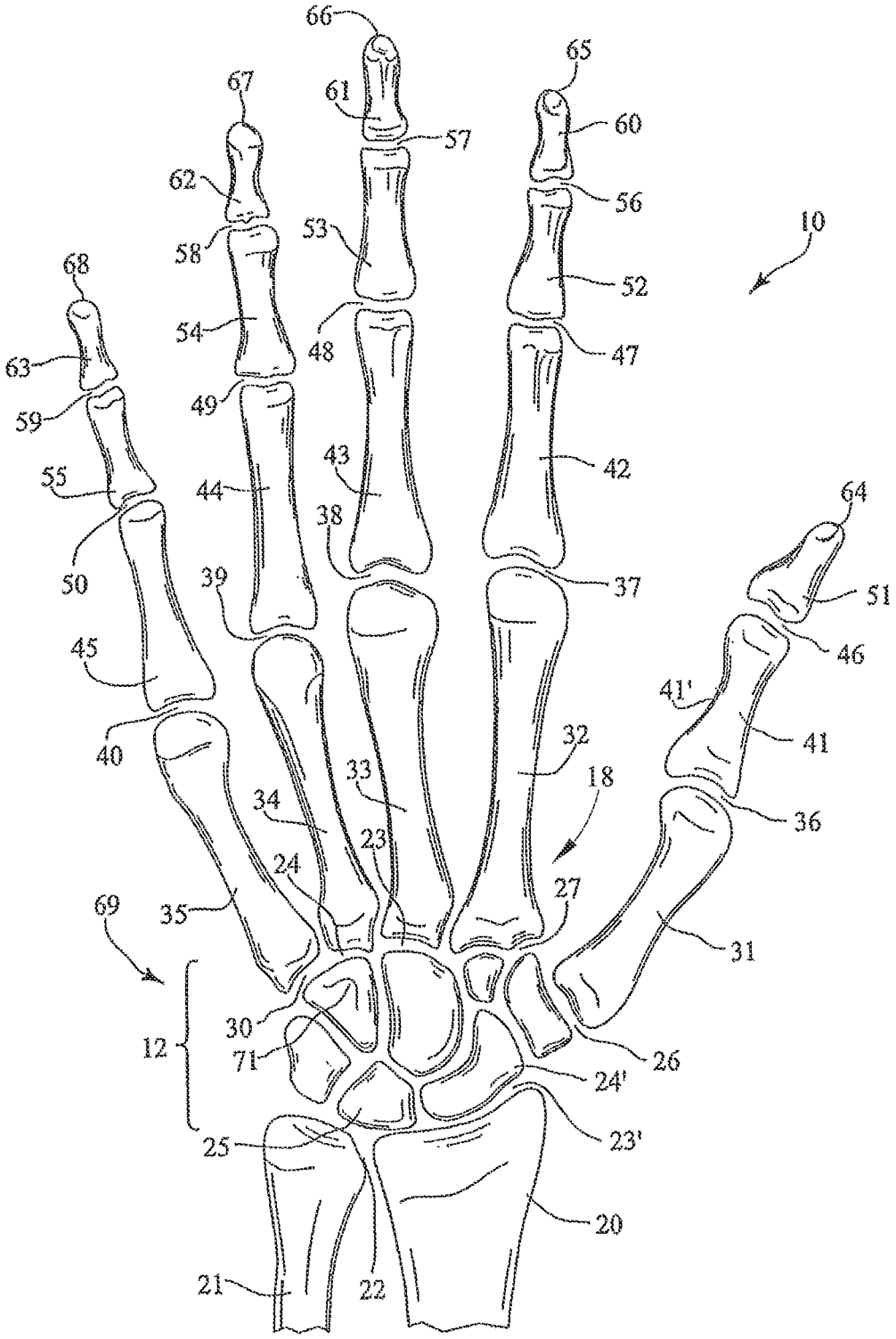
FIG. 1 is a bottom schematic anatomical view of the bones of a right-side human hand showing the palm-side details.

FIG. 1 is a schematic anatomical view of the bones of a right human hand 10 looking at a palm 18 side. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. The carpus 69 comprises eight carpal bones, seven of which are shown in FIG. 1 and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 2:
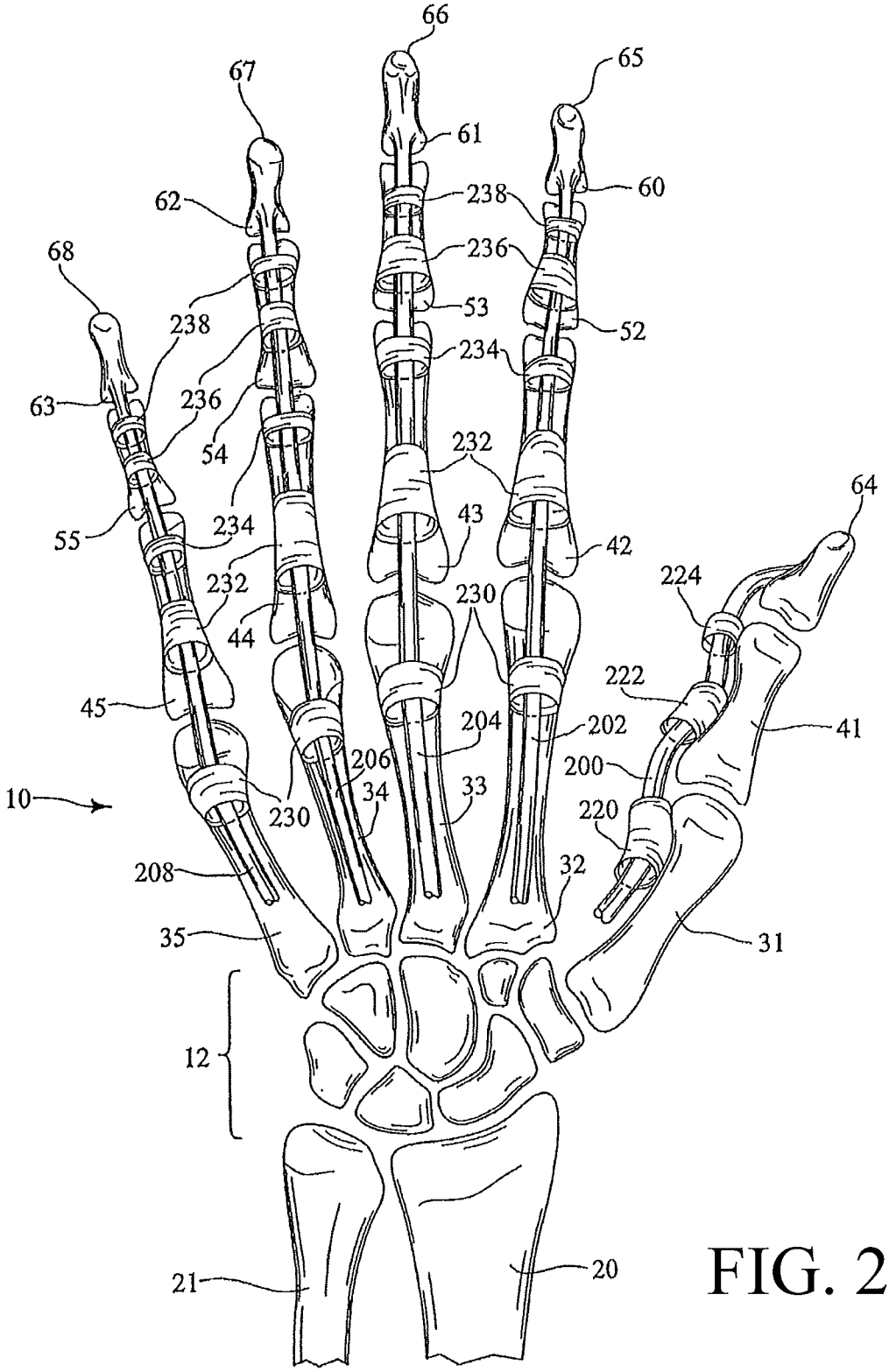
FIG. 2 is a bottom schematic anatomical palm-side view of the bones, and selected details of the pulleys and tendons of a right-side human hand.

FIG. 2 shows the skeletal anatomy, pulley system, and flexor tendons of the thumb 64 and fingers 65-68 of the right hand 10. The thumb 64 includes the flexor tendon (flexor pollicis longus) 200 and the three pulleys 220-224 of the thumb 64; an A1 pulley 220, A2 pulley 222, and A3 pulley 224. The A2 pulley 222 is the most important for function and is attached to the proximal phalanx 41 of the thumb 64. The respective pulleys 230-238 are also shown for each of the: index finger 65, long finger 66, ring finger 67, and small finger 68. Each finger 65-68 has five pulleys 230-238; an A1 pulley 230, A2 pulley 232, A3 pulley 234, A4 pulley 236, and A5 pulley 238. The A2 pulley 232 and A4 pulley 236 are considered to be the most important for function. The A2 pulley 232 is attached to the proximal phalanx 42-45. The A4 pulley 236 is attached to the middle phalanx 52-55. The A1 pulley 230 is near the MCP joint 37-40, the A3 pulley 234 is near the PIP joint 47-50 and the A5 pulley 238 is near the DIP joint 56-59.

The flexor tendons 202-208 are shown as one unit for each finger 65-68, but actually there are two flexor tendons to each unit. They are the flexor digitorum superficialis and the flexor digitorum profundus (shown as one, 202-208). These tendons 202-208 travel underneath the pulleys 230-238 and the flexor digitorum profundus tendon attaches to the distal phalanx 60-63 of each finger 65-68. The tendons 202-208 move back and forth below the pulleys 230-238, via muscles (not shown) attached to the proximal end of the tendons. This movement of the tendon 202-208 produces finger 65-68 flexion. The pulleys 230-238 prevent the flexor tendons 202-208 from bowstringing or moving away from the bone with finger 65-68 flexion. If the pulleys 230-238 are damaged and no longer function, the tendons 202-208 will bowstring with a resultant significant loss of finger motion as well as grip strength. As such, pulleys 230-238, especially the A2 pulley 232 and the A4 pulley 236, are very important and must be preserved and protected as much as possible.

Figure 3:
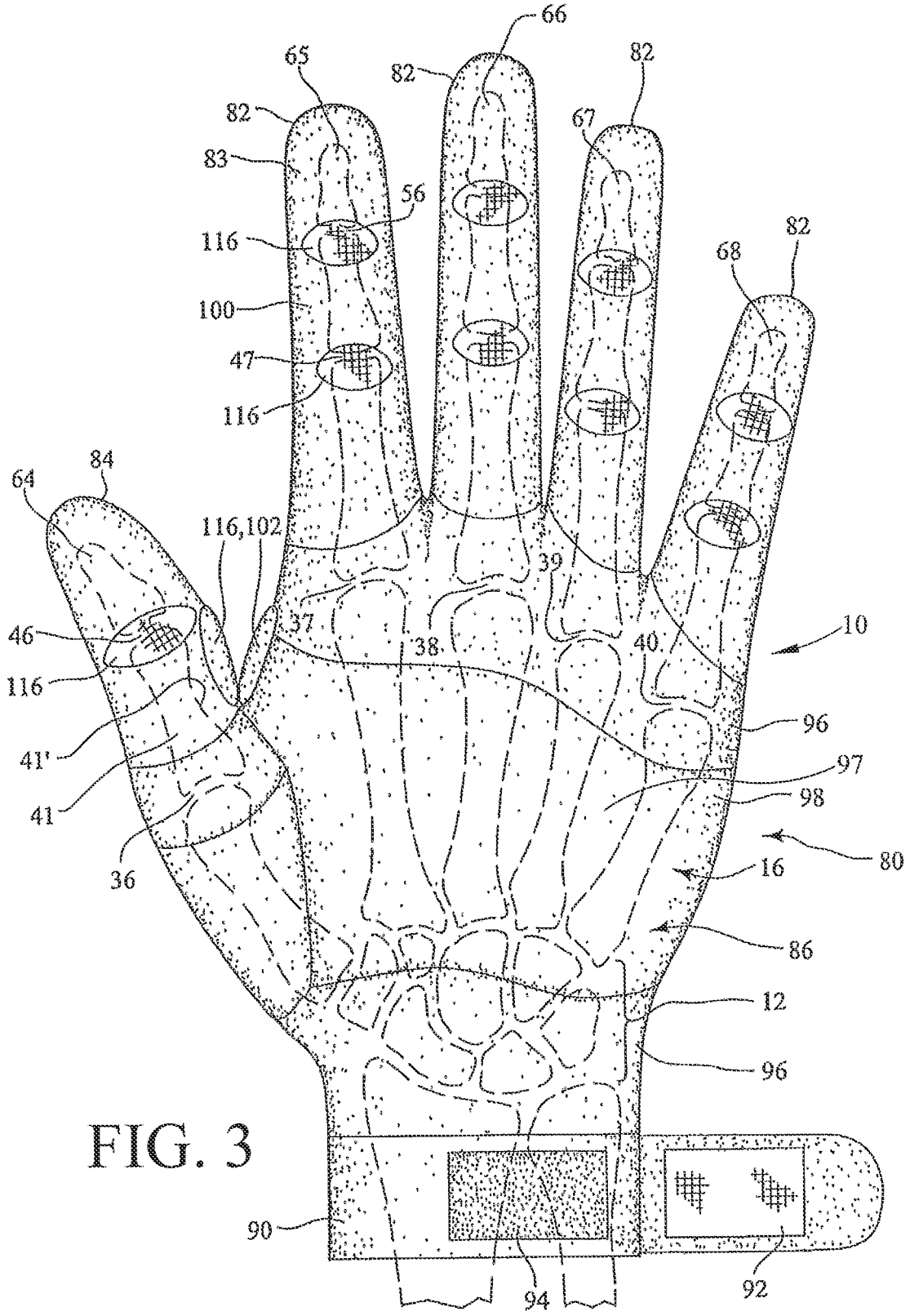
FIG. 3 is a top view of a glove showing the dorsal-side details and seen overlaying the skeletal structure of a right-dorsal-side human hand.
Figure 4:
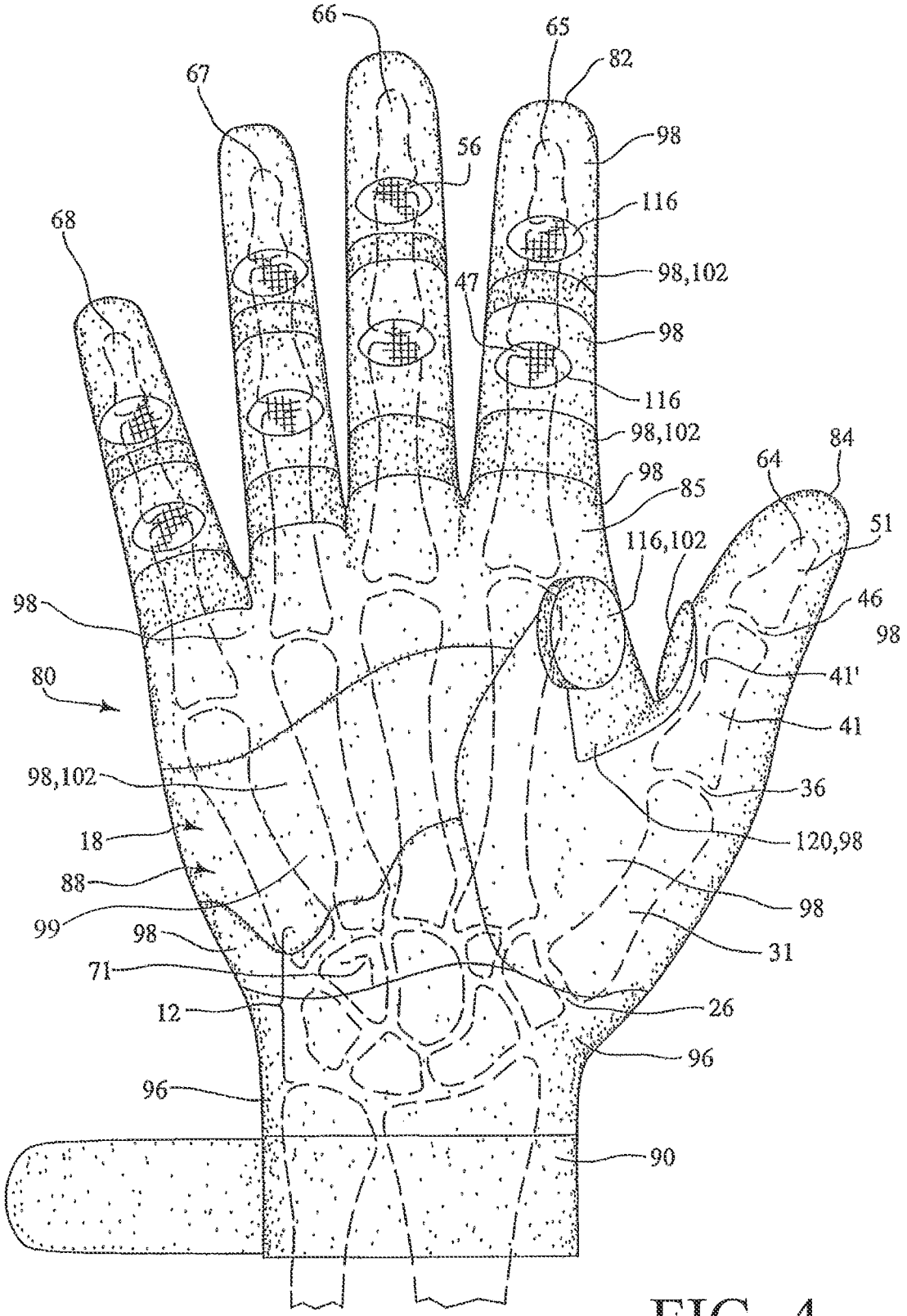
FIG. 4 is a bottom view of a batting glove showing the palmar side details and seen overlaying the skeletal structure of a right-palm-side human hand.
Figure 5:
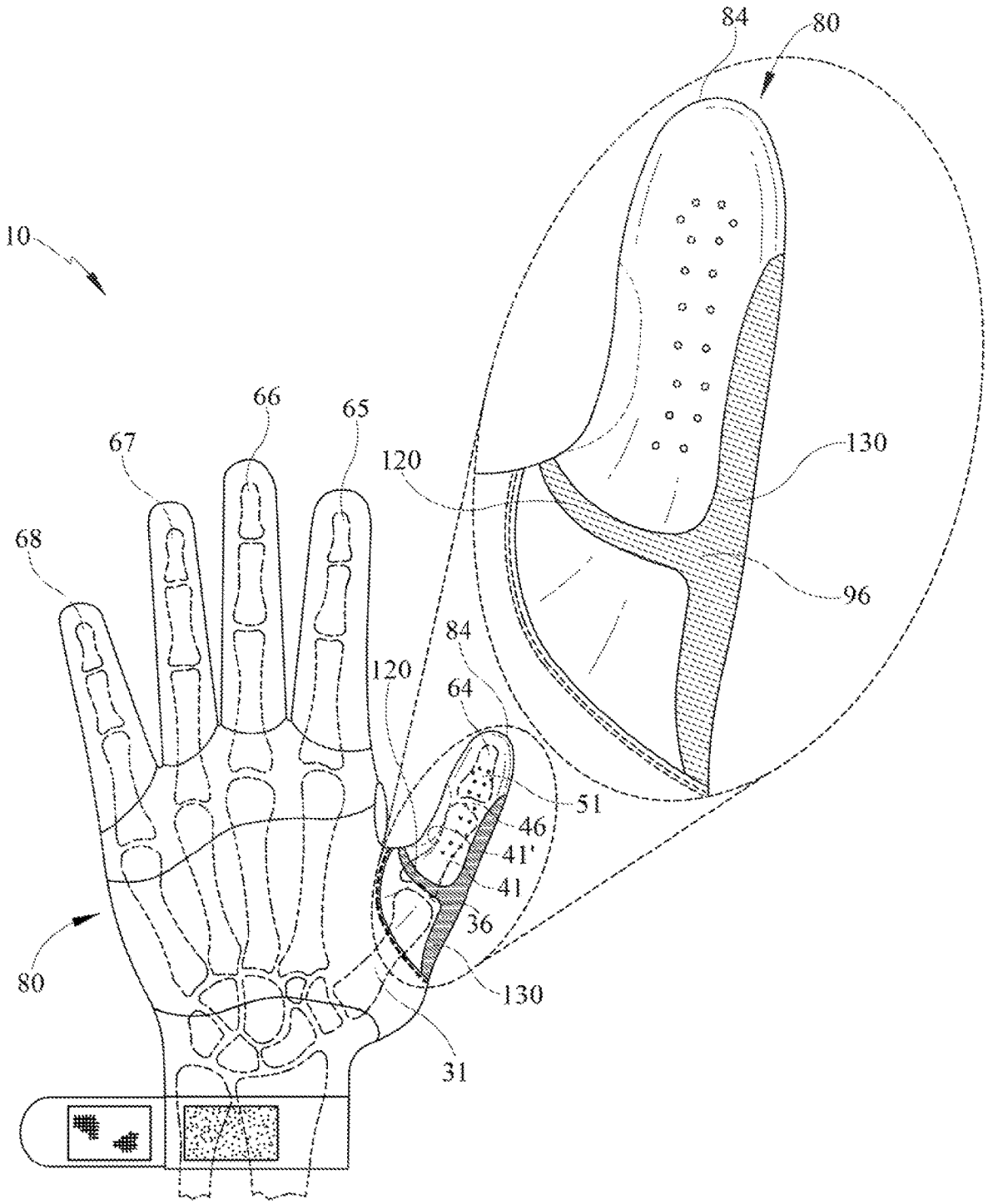
FIG. 5 is a perspective view of a thumb stall of the present invention showing details thereof.

Referring now to FIG. 3, there is shown details of a dorsal side 16 of an exemplary but not limiting glove 80 to cover a human hand 10 and seen overlaying the skeletal structure and skin outline of a right-dorsal-side human hand 10. Referring also to FIGS. 4 and 5 glove 80 has a plurality of finger elements 82, a thumb element 84, a top portion 86, and a lower portion 88 wherein the finger elements 82 cover fingers 65-68. The thumb element 84 covers a thumb 64, and the top portion 86 covers a back or dorsal side 16 of the hand 10. The lower portion 88 covers the palmar side 18 of the hand 10. Glove 80 further includes a dorsal side panel 97 and a palmar side panel 99 to which finger 82 and thumb 84 elements are secured. Dorsal side panel 97 and palmar side panel 99 are secured along each panel's outer periphery with an opening therein to receive a hand 10, said dorsal side panel 97 being sized to cover the back of said hand 10 and in conjunction with said palmar side panel 99 providing thumb stall 84 and finger stalls 82.

In one non-limiting embodiment of the invention an elastic band 90 may be attached to the top portion 86 and to the lower portion 88 for securing and retaining the glove around a wrist 12. The elastic band 90 includes a securing apparatus in the form of a hook 92 and loop 94 fastener or the equivalent thereof for retention of glove 80 above wrist 12.

The top portion 86 of glove 80 includes elastic material 96, preferably 2-WAY SPANDEX® in the vicinity of the wrist 12 out to the vicinity of the metacarpalphalangeal joints (MCP) 37-40 of the fingers 65-68 of the hand 10. Additionally, a protective covering 98 may be included in the dorsal side panel 97 to cover the back or dorsal side 16 of the hand 10.

The finger elements 82 each include an upper portion 83 which comprising synthetic material 100 with openings formed therein to receive thin elastic material 116 attached to cover the proximal interphalangeal joints (PIP) 47-50, and the distal interphalangeal joint (DIP) 56-59 of each finger 65-68. A lower portion 85 of the finger elements 82 may include protective covering 98. In addition, protective padding 102 is affixed beneath the protective covering 98 and adjacent to the fingers 65-68, in pre-selected areas.

The thumb element 84 may include protective covering 98 which surrounds the distal phalanx 51, metacarpalphalangeal joint (MCP) 36, proximal phalanx 41, metacarpal 31, and carpometacarpal joint (CMC) 26 of the thumb 64. As shown in FIG. 3, an opening is formed in the protective covering 98 to receive thin elastic material 116 attached to cover the interphalangeal joint (IP) 46 of the thumb 64. Another opening is formed in the protective covering 98 over the metacarpalphalangeal joint (MCP) 36 to receive thin elastic material 116.

Referring now to FIG. 5, and in accordance with a constructed but non-limiting embodiment of the invention, a glove 80 includes a thumb element 84 having a transverse or circumferential expansion zone 120 constructed of an elastic material 96, for example 2-Way Spandex or an equivalent elastic material. Transverse expansion zone 120 extends circumferentially around thumb 64 and is intersected by (and is co-extensive with) a longitudinal expansion zone 130, also constructed of a similar elastic material 96. Longitudinal expansion zone extends along thumb 64 and in one non-limiting embodiment may extends from distal phalanx 51 to metacarpal 31 to provide a longitudinal zone of expansion along substantially the entire length of the thumb 64.

Transverse expansion zone 120 and longitudinal expansion zone 130 act in concert to permit the expansion of thumb element 84 both longitudinally and circumferentially, thereby accommodating thumbs 64 having variable lengths and thicknesses without the necessity of radically altering the overall geometry and construction of glove 80. Furthermore, while the detailed description refers to a thumb element 84, one of ordinary skill in the art will recognize that the transverse 120 and longitudinal 130 expansion zones may be employed in any finger element 82 of glove 80 without departing from the scope of the invention.

Transverse expansion zone 120 permits the length of thumb element 84 to expand as a user's thumb 64 extends upwardly into thumb element 84 thereby adjusting for thumbs of differing lengths. In one embodiment of the invention transverse expansion zone 120 is comprised of elastic material 96 having a 2 mm relaxed width, which may expand up to 10 mm when stretched or when in an unrelaxed state. Similarly, longitudinal expansion zone 130 may comprise a 2-5 mm width of relaxed elastic material 96 to facilitate fingers or thumbs of differing circumferences.

In one embodiment of the invention transverse expansion zone 120 extends around approximately half of thumb element 84, proximate the MCP joint of thumb 64. This feature of the invention facilitates longitudinal expansion of thumb element 84 while still providing structure to element 84. Additionally, transverse expansion zone 120 may be located on either the palmar or dorsal side of thumb element 84 without departing from the scope of the invention. In a yet further non-limiting embodiment of the invention transverse expansion zone 120 may extend completely around thumb element 84.

Furthermore, in one embodiment of the invention longitudinal expansion zone 130 may extend from below MCP joint 36 to above IP joint 46 of thumb 64. Where longitudinal expansion zone 130 is provided in a finger stall 82, rather than a thumb stall 84, expansion zone 130 may extend from below MCP joints 37-40 to above the DIP joints 56-59 thereof. This feature of the invention provides for circumferential expansion of the thumb element 84 along a substantial length of thumb 64. Additionally, the intersection of the transverse 120 and longitudinal 130 expansion zones (that is to say, the areas where transverse 120 and longitudinal 130 expansion zones are co-extensive) allows glove 80 to expand in multiple directions to accommodate a wide variety of thumb 64 sizes, particularly proximate the MCP joint 36.

In a yet further embodiment of the invention elastic material 96 is provided in both transverse 120 and longitudinal 130 expansion zones in widths sufficient to permit the finger or thumb element 84 to expand one full glove size. In other words, elastic material 96 in expansion zones 120, 130 is sized to provide a one size expansion in the applicable finger or thumb. This feature of the invention is particularly advantageous in application such as batting gloves or golf gloves that are typically worn form-fitting by users, and where an over-sized thumb 84 or finger 82 stall may cause a user to be uncomfortable in a glove 80 that otherwise fits well.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

The invention claimed is:

1. A glove comprising:

a palmar side panel and a dorsal side panel secured along each panel's outer periphery with an opening therein adapted to receive the human hand, said dorsal side panel being sized to cover the back of the hand and in conjunction with said palmar side panel providing a thumb stall and a plurality of finger stalls for receiving the thumb and fingers of the human hand;

said thumb stall having one or more transverse expansion zones and a longitudinal expansion zone, each of said expansion zones comprised of expandable material connecting an outer periphery of one or more remaining portions of said thumb stall allowing at least one of circumferential and longitudinal expansion of said thumb stall; and wherein said longitudinal expansion zone extends along a radial side of said thumb stall above and below in opposing directions of a first portion of the one or more transverse expansion zones, wherein a second portion of said one or more transverse expansion zones extends circumferentially about said thumb stall away from said longitudinal expansion zone without said longitudinal expansion zone extending above and below in the opposing directions therefrom, and wherein the longitudinal expansion zone of said thumb stall is configured to extend continuously from below the metacarpalphalangeal joint of the thumb to above the interphalangeal joint of the thumb.

2. The glove of claim 1 wherein said expansion zones are comprised of a single layer of elastic material.

3. The glove of claim 2 wherein at least a portion of said elastic material is a spandex material.

4. The glove of claim 1 wherein said one or more expansion zones have a first width of approximately two millimeters in a first state when not worn and a second width in a second state when worn, wherein said second width is larger than said first width.

5. The glove of claim 1 wherein said one or more transverse expansion zones extends circumferentially around said thumb stall approximately half way.

6. The glove of claim 1 wherein said one or more transverse expansion zones and said longitudinal expansion zone intersect.

7. The glove of claim 1 wherein said one or more transverse expansion zones is located proximate the metacarpalphalangeal joint of the thumb of the hand.

8. The glove of claim 1 wherein said glove further includes a thumb opening connecting with said thumb stall, and wherein said longitudinal expansion zone is configured to extend continuously from said thumb opening to above the interphalangeal joint of the thumb.

9. The glove of claim 1 wherein said one or more transverse expansion zones is positioned on a dorsal side of said thumb stall.

10. The glove of claim 9 wherein said one or more transverse expansion zones is positioned on a palmer side of said thumb stall.

11. The glove of claim 1 wherein said one or more transverse expansion zones is positioned on a palmer side of said thumb stall.

12. A glove comprising:

a palmar side panel and a dorsal side panel secured along each panel's outer periphery with an opening therein adapted to receive the human hand, said dorsal side panel being sized to cover the back of the hand and in conjunction with said palmar side panel providing a thumb stall and a plurality of finger stalls for receiving the thumb and fingers of the human hand;

said thumb stall having one or more transverse expansion zones and a longitudinal expansion zone, wherein said one or more transverse expansion zones and said longitudinal expansion zone connect an outer periphery of one or more remaining portions of said thumb stall together allowing at least one of circumferential and longitudinal expansion of said thumb stall;

wherein said longitudinal expansion zone extends along a radial side of said thumb stall, and wherein said longitudinal expansion zone of said thumb stall is configured to extend continuously from below the metacarpalphalangeal joint of the thumb of the hand to above the distal interphalangeal joint of the thumb;

wherein said longitudinal expansion zone includes an upper portion extending from the one or more transverse expansion zones in a first direction and a lower portion extending from the one or more transverse expansion zones in an opposing second direction, and wherein said one or more transverse expansion zones laterally extends from the longitudinal expansion zone in the direction circumferentially away from said upper portion and said lower portion of said longitudinal expansion zone; and wherein said one or more transverse expansion zones is positioned on at least one of a dorsal side and a palmer side of said thumb stall.

13. The glove of claim 12 wherein said one or more transverse expansion zones is positioned on the dorsal side of said thumb stall.

14. The glove of claim 13 wherein said one or more transverse expansion zones is positioned on the palmer side of said thumb stall.

15. The glove of claim 12 wherein said one or more transverse expansion zones is positioned on the palmer side of said thumb stall.

16. The glove of claim 12, said wherein said one or more transverse expansion zones is configured to be located proximate the metacarpalphalangeal joint of the thumb of the human hand.

17. The glove of claim 12 wherein said one or more transverse expansion zones circumferentially extends around said thumb stall approximately half way.

18. A glove comprising:

a palmar side panel and a dorsal side panel secured along each panel's outer periphery with an opening therein adapted to receive the human hand, said dorsal side panel being sized to cover the back of the hand and in conjunction with said palmar side panel providing a thumb stall and a plurality of finger stalls for receiving the thumb and fingers of the human hand;

at least one finger stall of said plurality of finger stalls having a transverse expansion zone and a longitudinal expansion zone, wherein said transverse expansion zone and said longitudinal expansion zone connect an outer periphery of one or more remaining portions of said at least one finger stall together allowing at least one of circumferential and longitudinal expansion of said at least one finger stall;

wherein said longitudinal expansion zone extends along a radial side of said at least one finger stall, and wherein said longitudinal expansion zone of said at least one finger stall is configured to extend continuously from below the metacarpalphalangeal joint of the finger of the hand to above the distal interphalangeal joint of the finger; and wherein said longitudinal expansion zone includes an upper portion is configured to extend from the transverse expansion zone in the direction towards the distal interphalangeal joint of the finger and a lower portion is configured to extend from the transverse expansion zone in the opposing direction towards the metacarpalphalangeal joint of the finger, and wherein said transverse expansion zone laterally extends from the longitudinal expansion zone in the direction circumferentially away from said upper portion and said lower portion of said longitudinal expansion zone.

19. The glove of claim 18 wherein said transverse expansion zone extends circumferentially around said at least one finger stall approximately half way.

20. The glove of claim 18 wherein said transverse expansion zone and said longitudinal expansion zone intersect.

* * * * *